US005709910A

United States Patent [19]

Argyle et al.

[11] Patent Number: 5,709,910

[45] Date of Patent: Jan. 20, 1998

[54] METHOD AND APPARATUS FOR THE APPLICATION OF TEXTILE TREATMENT COMPOSITIONS TO TEXTILE MATERIALS

[75] Inventors: Mark D. Argyle; William Alan Propp, both of Idaho Falls, Id.

[73] Assignee: Lockheed Idaho Technologies Company, Idaho Falls, Id.

[21] Appl. No.: 554,127

[22] Filed: Nov. 6, 1995

[51] Int. Cl.[6] ..... B05D 1/18

[52] U.S. Cl. ..... 427/434.2; 427/434.6; 427/434.7; 8/151.2; 68/5 D; 68/5 E; 68/181 R; 118/405; 118/407; 118/420; 118/DIG. 19

[58] Field of Search ..... 427/355, 434.2, 427/434.6, 434.7; 118/229, 405, 407, 420, DIG. 19; 68/5 D, 5 E, 181 R; 8/151.2

[56] References Cited

U.S. PATENT DOCUMENTS

| | | | |
|---|---|---|---|
| 2,545,006 | 3/1951 | Ryan | 118/DIG. 19 |
| 2,642,035 | 6/1953 | McDermott | 118/405 |
| 4,287,238 | 9/1981 | Stavros | 427/349 |
| 4,582,731 | 4/1986 | Smith | 427/421 |
| 4,933,404 | 6/1990 | Beckman et al. | 526/207 |
| 5,156,888 | 10/1992 | Haubs et al. | 427/163 |
| 5,158,704 | 10/1992 | Fulton et al. | 252/309 |
| 5,238,671 | 8/1993 | Matson et al. | 423/397 |
| 5,266,205 | 11/1993 | Fulton et al. | 210/639 |
| 5,499,911 | 3/1996 | Nakata et al. | 8/151.2 |

FOREIGN PATENT DOCUMENTS 2907733 9/1980 Germany .

OTHER PUBLICATIONS

*Handbook of Chemistry and Physics*, CRC Press, Inc., Cleveland, Ohio, pp. F-80 to F-80, 55th ed. (1974–1975).

*Primary Examiner*—Shrive Beck
*Assistant Examiner*—Brian K. Talbot
*Attorney, Agent, or Firm*—Klaas Law O'Meara & Malkin

[57] ABSTRACT

A system for applying textile treatment compositions to textile materials. A conduit member is provided which includes a passageway having a first end, a second end, and a medial portion with a constricted (narrowed) region. The passageway may include at least one baffle having an opening therethrough. A yarn strand is then moved through the passageway. A textile treatment composition (a sizing agent or dye) dissolved in a carrier medium (a supercritical fluid or liquified gas) is thereafter introduced into the constricted region, preferably at an acute angle relative to the passageway. The carrier medium expands inside the passageway which causes delivery of the treatment composition to the yarn. The treated yarn then passes through the baffle (if used) which facilitates drying of the yarn. During this process, a carrier gas can be introduced into the passageway to ensure the production of a smooth, dry product.

18 Claims, 1 Drawing Sheet

METHOD AND APPARATUS FOR THE APPLICATION OF TEXTILE TREATMENT COMPOSITIONS TO TEXTILE MATERIALS

CONTRACTUAL ORIGIN OF THE INVENTION

The United States has rights in this invention pursuant to contract number DE-AC07-94ID13223 between the U.S. Department of Energy and Lockheed Idaho Technologies Company.

BACKGROUND OF THE INVENTION

The present invention generally relates to textile processing, and more particularly to the treatment of textile materials with a variety of different chemical compositions in a rapid and efficient manner.

In the production of textile materials, individual threads (hereinafter designated as "yarn strands") are woven using a loom in a variety of patterns. Each yarn strand includes a plurality of fibers as discussed below. To facilitate the weaving process, a procedure known as "sizing" is employed to increase the tensile strength and abrasion resistance of the individual strands. Likewise, the sizing process reduces the number of extraneous, outwardly-extending yarn fibers associated with each strand. As a result, the yarn strands are more easily processed in subsequent portions of the weaving system, including the shedding harness and other sub-systems. Furthermore, sizing is required to reduce the number of yarn strands that break during the high-speed weaving process. The breakage of a yarn strand typically occurs due to mechanical failure of the strand caused by abrasion or snagging with adjacent strands. Snagging caused by adjacent strands results when each strand includes a substantial number of individual fibers which extend outwardly from the strand instead of being engaged in a tight arrangement around the strand surface.

Many techniques have been employed to accomplish the sizing of textile materials. These techniques basically involve the application of one or more sizing agents to each of the yarn strands in order to provide the benefits listed above. Chemically, these benefits are achieved by coating the strands to produce a smooth surface with a minimal number of outwardly-extending yarn fibers. Many different chemical materials in solid or liquid form have traditionally been used as sizing agents including but not limited to acrylates, acrylic acid monomers, acrylic acid polymers, ammonium salts of polyacrylic acid, ammonium salts of acrylic copolymers, polyacrylates, polyacrylic acid, polyvinyl chloride, polyvinyl acetate, polyvinyl alcohol, carboxymethyl cellulose, hydroxyethyl cellulose, sodium alginate, and various starch compositions (e.g. carboxymethyl starches and potato starch). These materials are applied to the yarn strands so that they are coated and/or saturated with the selected compositions. Application of the sizing agents may be undertaken in many different ways. A conventional and widely-used technique is known as "slashing". This procedure specifically involves dipping the yarn strands into a box or chamber containing an aqueous (liquid) sizing agent, followed by subsequent drying of the yarn prior to further processing. However, this process requires a substantial amount of thermal energy to completely dry the yarn which is saturated and/or coated with the aqueous sizing agent. Furthermore, conventional dipping methods typically cause the adhesion of adjacent yarn strands together by the sizing agents on each strand. This situation is corrected by physically separating the strands using a procedure known as "leasing". Leasing involves the mechanical separation of adjacent yarn strands using bar-like structures also known as "lease rods" or "bust bars", followed by passage of the strands through a comb prior to winding onto a loom beam. While this process is effective for its intended purpose, it is labor-intensive and requires a significant amount of system down-time. In addition, residual amounts of unused sizing agents often remain within the processing chamber which must be removed when the system is cleaned. To effectively clean the sizing chamber (which is necessary for efficient operation and minimal down-time), the chamber must be physically drained, filled with water, and heated to high temperature levels so that any residual sizing agents are boiled out.

In addition to the situation described above which is labor-intensive and involves significant losses of sizing agents, other difficulties exist when conventional processes are employed. For example, when yarn strands are processed using an immersion chamber, a layer of residue (e.g. scum) often forms on the materials within the chamber. This situation interferes with the sizing process, and prevents efficient operation of the textile treatment system.

In addition to the application of sizing agents, other materials are also applied to the textile strands. These other materials (as well as the sizing agents described above) are collectively designated herein as "textile treatment compositions". For example, as discussed below, textile dyes in many different colors are also applied to the individual strands of yarn. The application of textile dyes traditionally involves the controlled dipping or immersion of the yarn strands in a selected dye composition retained within a chamber. The strands are then air-dried which, in many cases, causes oxidation of the dye to produce a desired final color. However, substantial amounts of dye are lost using this process due to spillage and the required cleaning processes associated with the immersion chamber.

The present invention involves a substantial departure from conventional textile treatment methods and avoids the problems described above. It does not use a system in which the yarn strands are dipped or immersed within textile treatment compositions in a chamber. As a result, the present invention uses the textile treatment compositions in a more efficient manner with less waste. The lack of an immersion chamber also avoids the cleaning problems associated with conventional systems. Finally, the claimed method is characterized by reduced processing costs, minimal labor requirements, and a reduction in the amount of drying which is needed to prepare the final product. The present invention therefore represents an advance in the art of textile processing as further discussed below.

SUMMARY OF THE INVENTION

It is an object of the present invention to provide a system for applying textile treatment compositions (e.g. sizing agents and/or chemical dyes) to textile materials in a highly efficient and rapid manner.

It is another object of the invention to provide a system for applying textile treatment compositions to textile materials which uses a minimal amount of equipment and a reduced number of processing steps.

It is further object of the invention to provide a system for applying textile treatment compositions to textile materials which achieves a reduction in material costs by avoiding the direct immersion and/or dipping of individual yarn strands into large amounts of the selected compositions.

It is a further object of the invention to provide a system for applying textile treatment compositions to textile materials which minimizes the generation of waste products and unused materials.

It is a still further object of the invention to provide a system for applying textile treatment compositions to textile materials which produces a treated yarn product having improved surface characteristics (e.g. increased tensile strength, improved abrasion resistance, and a minimal amount of stray, outwardly-extending yarn fibers in each strand).

It is a still further object of the invention to provide a system for applying textile treatment compositions to textile materials which reduces the amount of drying that is needed to prepare a completed yarn product compared with prior treatment methods.

It is a still further object of the invention to provide a system for applying textile treatment compositions to textile materials which is especially appropriate for use in mass production manufacturing processes.

It is a still further object of the invention to provide a system for applying textile treatment compositions to textile materials which uses minimal amounts of labor while increasing the rate at which treated yarn products are manufactured.

It is an even further object of the invention to provide a system for applying textile treatment compositions to textile materials in which the above-listed goals are accomplished by the initial preparation of a mixture containing a pressurized carrier medium and a textile treatment composition which is applied to yarn materials in a specialized apparatus. As a result, the textile treatment composition is efficiently delivered to the yarn while avoiding problems associated with immersion-type processes.

In accordance with the foregoing objects, the present invention involves a highly efficient method for the application of a selected textile treatment composition to a yarn strand (e.g. thread). The claimed process is applicable to many different compositions including sizing agents and textile dyes. In this regard, the present invention shall not be limited to the application of any particular materials to the selected textile products.

To apply a textile treatment composition to a yarn strand using the claimed process, a conduit member is initially provided. The conduit member (which may be made from many different construction materials including stainless steel) includes at least one passageway extending (passing) entirely through the conduit member from one end to the other. The passageway is surrounded by a side wall, and includes a first end portion, a second end portion, and a medial portion between the first and second end portions. The passageway is preferably circular in cross-section and includes a longitudinal center axis. As discussed below, the medial portion includes at least one section in which the side wall extends inwardly to form a venturi-like constricted region within the passageway. In a preferred embodiment, the second end portion of the passageway includes at least one vertical baffle member having an opening therethrough.

Next, a yarn strand (which involves a single textile thread consisting of multiple fibers) is provided which is passed through the passageway so that the strand moves continuously within the conduit member during treatment. The strand may be constructed from many different natural and synthetic materials including cotton, linen, polyester, nylon, rayon, cotton blends, and the like. In this regard, the present invention shall not be exclusively limited to the treatment of any particular textile products.

A chemical treatment mixture is then introduced into the passageway at the constricted region of the medial portion. Introduction of the mixture is accomplished during movement of the yarn strand through the passageway. In a preferred embodiment, the mixture is initially stored within a chamber connected to and in fluid communication with the passageway, with the mixture being delivered to the constricted region of the passageway from the chamber (e.g. delivered directly into the constricted region or slightly ahead of the constricted region). The mixture consists of a selected textile treatment composition dissolved or otherwise dispersed within a carrier medium. The textile treatment composition will preferably comprise a sizing agent or a textile dye. In a preferred embodiment, the carrier medium will involve a product consisting of either a supercritical fluid or a liquified gas. To generate the supercritical fluid or liquified gas, a selected chemical composition is pressurized and heated to desired levels as discussed below. Exemplary supercritical fluids, liquified gases, sizing agents, and textile dyes will be provided below in the section entitled "Detailed Description of Preferred Embodiments". In addition, a more detailed discussion of supercritical fluids and liquified gases will be presented below, including definitions of these terms and the conditions used in producing both products. It should also be noted that the selected carrier medium and textile treatment composition may be combined with at least one optional solvent prior to introducing the mixture of these ingredients into the constricted region of the passageway. The solvent is designed to facilitate dissolution of the textile treatment composition into the carrier medium.

To achieve optimum results, the mixture is introduced into the medial portion at or slightly before the constricted region of the passageway at an angle relative to the longitudinal axis of the passageway. In a preferred embodiment, the mixture will be introduced into the passageway at an acute angle relative to the longitudinal axis of the passageway, with the term "acute angle" as used herein involving an angle of less than 90°. As a result, any individual yarn fibers attached to and extending outwardly from the strand will wrap tightly around the strand during introduction of the mixture into the constricted region of the passageway. When the mixture is introduced into the passageway, the carrier medium experiences a significant drop in pressure and rapidly expands. This situation causes the textile treatment composition to precipitate out of the mixture as a liquid or (in some cases) a solid. The textile treatment composition then comes in contact with and is applied to the yarn strand to produce a treated yarn product which is impregnated and covered with the treatment composition. If a conduit member is used which includes at least one vertical baffle member in the second end portion of the passageway as previously indicated, the treated yarn product will subsequently pass through the opening in the baffle member at the second end portion. This procedure assists in drying the yarn product as further discussed below. After precipitation of the textile treatment composition onto the yarn strand, the chemical composition used to produce the carrier medium will remain within the passageway. If desired, the chemical composition may be transferred from the passageway back into the chamber for reuse in treating additional quantities of yarn which enter the textile treatment apparatus.

To increase the efficiency of the treatment process, a number of additional processing steps may be undertaken if needed as determined by preliminary experimental testing. For example, a selected carrier gas may be introduced into the medial portion of the passageway during delivery of the chemical treatment mixture into the constricted region of the passageway as described above. As a result, the carrier gas will pass over and around the yarn strand as it moves through the constricted region of the passageway. This step facilitates the wrapping of individual yarn fibers around each yarn strand, and also assists in drying the treated yarn product.

Finally, an additional gas (e.g. a "seal gas") may be introduced into at least one of the first end portion and the second end portion of the passageway during delivery of the chemical treatment mixture into the constricted region of the passageway. Introduction of the additional gas in this manner produces back-pressure within the passageway which prevents air from entering the passageway of the conduit member via the first and second end portions. The additional gas likewise prevents leakage of the textile treatment composition and carrier medium out of the system through the first and second end portions of the passageway. Further information regarding specific compositions which can be used as the carrier gas and the additional gas will be listed below along with a more detailed explanation regarding the functional capabilities of these materials.

The present invention provides numerous benefits compared with prior methods for applying textile treatment compositions to textile materials. These benefits include but are not limited to: (1) the rapid application of many different compositions using a minimal amount of processing equipment; (2) the more efficient use of textile treatment compositions with reduced waste; (3) a reduction in the required level of system maintenance and cleaning; (4) the ability to more rapidly and efficiently apply textile treatment compositions to a yarn strand while avoiding the problems associated with dipping/immersion methods; and (5) the ability to treat textile products on a mass production basis with a minimal amount of labor and equipment. The foregoing description involves a summary of the present invention and its basic processing steps. More detailed information regarding the claimed process, as well as additional objects, features, and advantages of the method will be described in the following Brief Description of the Drawings and Detailed Description of Preferred Embodiments.

DETAILED DESCRIPTION OF PREFERRED EMBODIMENTS

Figure 1:
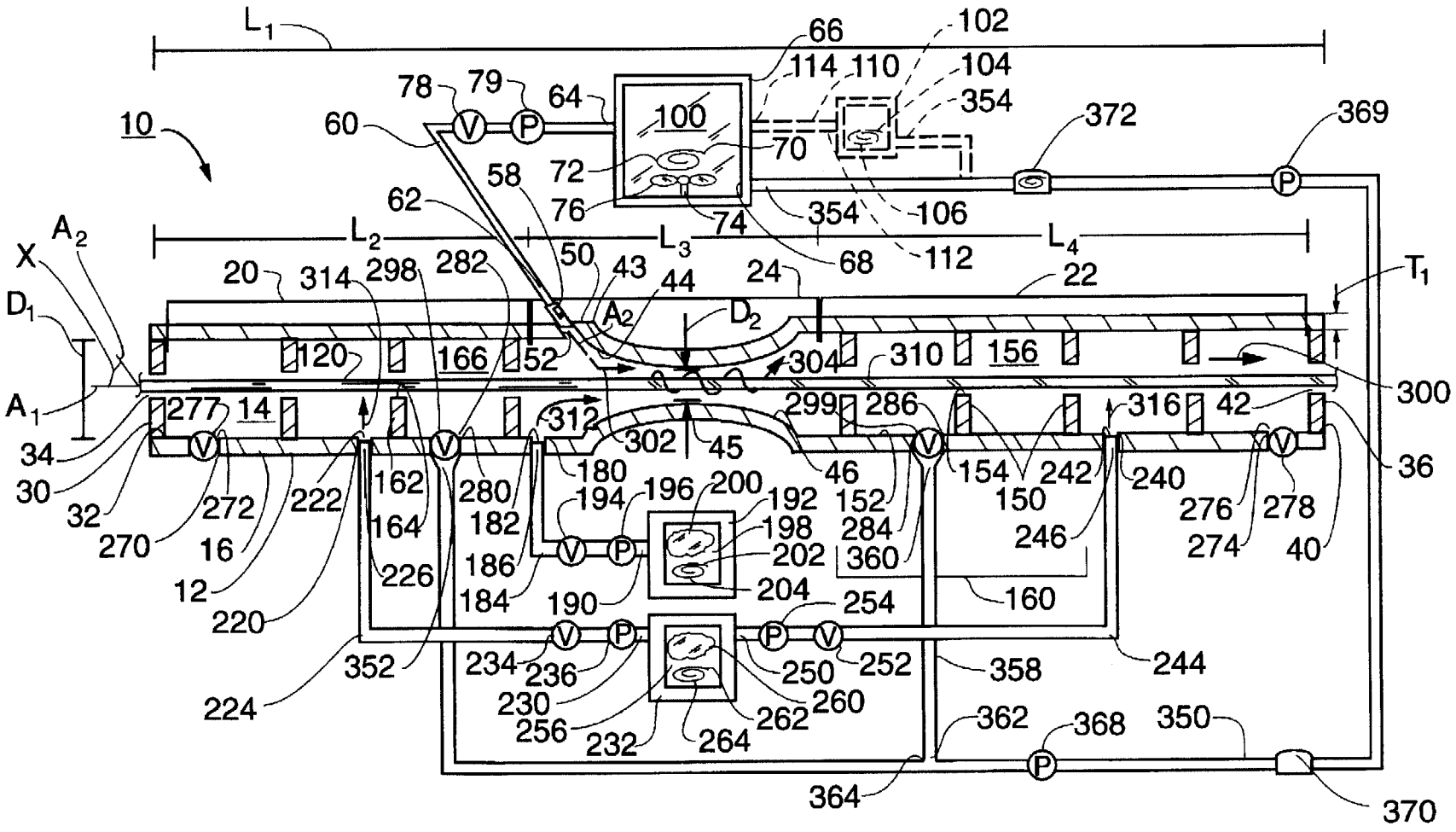
FIG. 1 is a schematic illustration (partially in cross-section) of the components, materials, and process steps used in accordance with a preferred embodiment of the present invention to produce a treated yarn product.

The present invention involves a rapid and efficient method for applying textile treatment compositions to textile materials. It is characterized by a number of benefits as previously discussed. The term "textile materials" as used herein shall involve individual yarn strands as discussed below which are subsequently used to produce a woven textile product. The claimed process is prospectively applicable to many different textile treatment compositions and textile products. In this regard, the present invention shall not be limited to the specific compositions and textile materials described in the following Detailed Description. Likewise, the processing parameters listed below (e.g. pressure levels, temperature values, size parameters, and the like) are provided for example purposes and may be varied in accordance with routine experimental testing on the specific materials being treated.

A. The Processing System

A representative textile treatment apparatus in the form of a processing system 10 is schematically illustrated in FIG. 1. The system 10 is designed to efficiently produce treated textile products in accordance with the claimed processing method. The size and capacity of the system 10 can be varied in view of the desired amount of textile materials to be treated. With continued reference to FIG. 1, the system 10 includes an elongate conduit member 12 shown cross sectionally in FIG. 1. The conduit member 12 many involve many different shapes and sizes, with the present invention not being limited to any particular configuration. Likewise, numerous construction materials may be used to produce the conduit member 12 (e.g. metals, plastics, ceramics, and the like) provided that the selected material is capable of maintaining structural integrity at high pressure and temperature levels (e.g. as high as about 10,000 psi and 59° F.). An exemplary and preferred material suitable for construction of the conduit member 12 will involve stainless steel.

Passing (e.g. extending) entirely through the conduit member 12 is a continuous passageway 14 surrounded by a side wall 16. While the size parameters associated with the conduit member 12 and passageway 14 may be varied as indicated above, the passageway 14 (and conduit member 12) will have a preferred length $L_1$ (FIG. 1) in the present embodiment of about 7–16 in. The thickness of the side wall 16 will preferably be uniform along the entire length of the passageway 14, with an optimal thickness $T_1$ in the present embodiment being about ⅛–⅜ in. While the embodiment of FIG. 1 involves the use of a passageway 14 with a circular cross-section section (which is preferred), the present invention shall likewise cover the use of alternative passageways having different cross-sectional configurations (e.g. square, rectangular, elliptical, and the like). The passageway 14 will also have a longitudinal center axis $A_1$ (FIG. 1), which will be described in greater detail below.

The passageway 14 further includes a first end portion 20, a second end portion 22, and a medial portion 24. Portions 20, 22, 24 are designated by the brackets in FIG. 1 which are used to shown the respective lengths of the portions 20, 22, 24 within the conduit member 12. In the embodiment of FIG. 1, the diameter values associated with the passageway 14 at the first end portion 20 and the second end portion 22 will preferably be equivalent. The diameter $D_1$ of the passageway 14 at both the first end portion 20 and the second end portion 22 will optimally be about ¼–½ in. in the present embodiment. However, this value may be varied, depending on the type and size of the yarn strand being processed and other system parameters. As discussed below, the passageway 14 and all of its sections should be sized to receive the yarn strand of interest without frictional engagement between the strand and the side wall 16.

With continued reference to FIG. 1, the first end portion 20 preferably includes a vertical end plate 30 of planar design secured within the conduit member 12 at position 32. The end plate 30 is preferably manufactured of the same materials used to produce the conduit member 12 (e.g. stainless steel as noted above). The end plate 30 is secured in position using conventional attachment methods selected in accordance with the construction materials of interest (e.g. welding, adhesive affixation, and the like). The end plate 30 further includes an opening 34 therein as shown in FIG. 1. In a preferred embodiment, the opening 34 will have a diameter sufficient to allow the selected yarn strand to pass therethrough without frictionally engaging the plate 30. The end plate 30 is designed and secured in position so that the longitudinal center axis $A_1$ of the passageway 14 will pass through the center of the opening 34.

In a similar manner, the second end portion 22 will include a vertical end plate 36 of planar design secured within the conduit member 12 at position 40. The end plate 36 preferably has the same shape and size parameters as the end plate 30, and is likewise manufactured from the same materials (e.g. stainless steel). It is secured in position in the same manner described above regarding the end plate 30. The end plate 36 further includes an opening 42 therein as shown in FIG. 1 which is preferably the same size as the opening 34 in the end plate 30. In a preferred embodiment, the opening 34 will have a diameter sufficient to allow the selected yarn strand to pass therethrough without frictional engaging the plate 36. To accomplish this goal, the end plate 36 is designed and secured in position so that the longitudinal center axis $A_1$ of the passageway 14 will pass through the center of the opening 42. Additional information regarding the end plates 30, 36 will be presented below.

With continued reference to FIG. 1, the medial portion 24 of the passageway 14 will now be discussed. As shown in FIG. 1, the medial portion 24 does not have the same size characteristics as the first and second end portions 20, 22. Specifically, the medial portion 24 includes a section 43 in which the side wall 16 of the passageway 14 extends inwardly to form a constricted region 44 which is narrower than any other part of the part of the medial portion 24 (or any section of the conduit member 12/passageway 14 in the embodiment of FIG. 1). This design configuration is clearly illustrated in FIG. 1. When a passageway 14 having a circular cross-section is used, the term "narrower" shall involve a relationship in which the diameter $D_2$ of the constricted region 44 of the passageway 14 at its narrowest point (e.g. position 45) is less than the diameter of the passageway 14 at any other position within the medial portion 24. In the specific embodiment of FIG. 1, the diameter $D_2$ of the constricted region 44 at position 45 is also less than the diameter at any other part of the passageway 14, including the first and second end portions 20, 22. As noted above, the $D_1$=the diameter of the passageway 14 at the first and second end portions 20, 22. While the present invention shall not be limited to this embodiment, efficient results will be achieved if $D_2<D_1$ by an amount to be determined in accordance with preliminary experimentation. By way of example, the system 10 illustrated in FIG. 1 will operate effectively when $D_2$ is less than $D_1$ by about 90–99%.

If a passageway 14 with a non-circular cross-section is used, the term "narrower" shall involve a situation in which the cross-sectional area of the constricted region 44 of the passageway 14 at position 45 is less than the cross-sectional area at any other point along the medial portion 24 of the passageway 14. When a passageway 14 with a square or rectangular cross-section is involved, the term "cross-sectional area" shall involve the height of the passageway 14 at the designated position times the width at the selected position. In the preferred embodiment of FIG. 1, the cross-sectional area at position 45 of the constricted region 44 is also less than the cross-sectional area at any other point along the passageway 14, including all locations at the first and second end portions 20, 22. However, the present invention shall not be exclusively limited to this embodiment which is provided for example purposes.

The passageway 14 shown in FIG. 1 has a circular cross-section as previously indicated with a side wall 16 of annular configuration. In a preferred embodiment, the diameter $D_2$ of the constricted region 44 of the passageway 14 at position 45 will be about 0.006–0.10 in. Again, this value may vary in accordance with preliminary pilot studies on the textile materials of interest. However, the diameter $D_2$ of the constricted region 44 should be sufficiently large to allow the yarn strand to pass therethrough without frictionally engaging the side wall 16.

As indicated above and shown in FIG. 1, the side wall 16 extends inwardly at section 43 of the medial portion 24 to form the constricted region 44. At the constricted region 44, the side wall 16 has an inwardly-curved, concave configuration schematically illustrated in FIG. 1. As a result, the interior surface 46 of the side wall 16 at the constricted region 44 will be arcuate and smooth (non-angled) as illustrated in FIG. 1. This arcuate design is preferred because it substantially eliminates disturbances (e.g. eddy currents and turbulence) in the fluid dynamics of the system 10 at the constricted region 44. The constricted region 44 in the medial portion 24 of the passageway 14 performs an important function in the present invention. Specifically, the constricted region 44 functions as a "venturi", with this term involving a constriction in a conduit which causes fluid materials to experience a drop in pressure as they flow through the conduit. In the system 10, the venturi characteristics of the constricted region 44 provide many benefits including the efficient spray-type delivery of a selected treatment composition to the desired textile materials, and the production of yarn strands having smooth surface characteristics with a minimal amount of extraneous, outwardly-extending fibers. The functional capabilities of the constricted region 44 will be discussed in further detail below.

The size relationship between the first end portion 20, the second end portion 22, and the medial portion 24 of the passageway 14 will vary in view of the specific materials to be treated using the system 10. However, in the exemplary embodiment of FIG. 1, the first end portion 20 will have a length $L_2$ of about 2–4 in., the medial portion 24 will have a length $L_3$ of about 2–4 in., and the second end portion 22 will have a length $L_4$ of about 3–8 inches. As shown in FIG. 1, the length $L_4$ of the second end portion 22 will optimally be greater than the length $L_2$ of the first end portion 20 and the length $L_3$ of the medial portion 24 in order to form an elongate zone within the second end portion 22 in which drying of the yarn strand can take place. This aspect of the present invention will be further discussed in the "Operation" section below.

With reference to FIG. 1, a treatment mixture inlet port 50 in the form of a elongate bore 52 is provided within the side wall 16 of the conduit member 12. The bore 52 (e.g. inlet port 50) is located adjacent to and in fluid communication with the constricted region 44 of the medial portion 24. Using the bore 52 (which provides access to the passageway 14), the selected textile treatment composition can be introduced directly into the constricted region 44 as discussed below. The bore 52 further includes a central longitudinal center axis $A_2$. While the present invention shall not be limited to any particular angular relationship between the bore 52 and the passageway 14, it is preferred that the bore 52 be tilted slightly downward (e.g. toward the first end portion 20) as shown in FIG. 1. In a preferred embodiment, the bore 52 (e.g. the inlet port 50) will be oriented at an acute angle relative to the longitudinal center axis $A_1$ of passageway 14. As previously noted, the term "acute angle" shall signify an angle of less than 90°. A graphic illustration of this relationship is provided in FIG. 1 in which the longitudinal axis $A_2$ of the bore 52 (e.g. inlet port 50) is oriented at an acute angle "X" relative to the longitudinal axis $A_1$ of the passageway 14. To achieve optimum results, angle "X" will be about 10°–70°. In accordance with this relationship, incoming textile treatment compositions will enter the constricted region 44 at an angle. As a result, these materials will rotate and swirl within the section 44. Swirling of the textile treatment composition in this manner provides many benefits, including (1) more complete coverage of the yarn strand; and (2) the more efficient wrapping of outwardly-extending yarn fibers around the yarn strand to produce a smoother and more uniformly-coated final product. Furthermore, the inlet port 50 (bore 52) may be positioned so that it is laterally offset (e.g. to the side of) the longitudinal center axis $A_1$ of the passageway 14 to further facilitate swirling of the textile treatment composition within the constricted region 44. In addition to the orientations listed above, the inlet port 50 (bore 52) may optionally be tilted sideways toward either side of the longitudinal center axis $A_1$ at a selected angle (e.g. an acute angle) to further facilitate swirling of the textile treatment composition within the constricted region 44. In this regard, the present invention shall not be limited to any particular angular relationship regarding the inlet port 50 (bore 52), with the selected orientation of the port 50 in any given situation being determined by preliminary tests. These aspects of the present invention and the benefits they provide will be discussed in greater detail below.

While the present invention shall not be limited to any hardware or components for delivering textile treatment compositions into the passageway 14, an exemplary system for this purpose is schematically shown in FIG. 1. Specifically, a nozzle 58 of conventional design is operatively connected to and secured within the bore 52 associated with the inlet port 50. A tubular conduit 60 is thereafter provided which includes a first end 62 and a second end 64. The term "tubular" as used herein shall generally signify an elongate structure having a bore or passageway therethrough surrounded by a continuous wall. The first end 62 of the conduit 60 is connected to the nozzle 58. The second end 64 of the conduit 62 is connected to a main chamber 66 designed to retain a chemical treatment mixture therein as discussed below. In this manner, the main chamber 66 is connected directly to the inlet port 50. The chamber 66 (which includes an interior region 68) is of conventional design and may be produced from many different construction materials. However, the chamber 66 should be designed and constructed to withstand internal pressures and temperatures as high as about 10,000 psi and about 590° F. In a preferred embodiment, the chamber 66 will be produced from stainless steel. It should also be noted that while only a single inlet port 50 and nozzle 58 are illustrated in the embodiment of FIG. 1, the system 10 may actually include multiple inlet ports 50 and nozzles 58 if desired in accordance with preliminary pilot studies. In this regard, the system 10 will preferably include from 1–10 inlet ports 50 each being connected to a nozzle 58 which communicates with the main chamber 66. To produce the chemical treatment mixture and maintain it at a desired temperature within the interior region 68 of the chamber 66, the chamber 66 will preferably include heating means 70 therein. In a preferred embodiment, the heating means 70 will consist of an electrical coil-type resistive heating element 72 of conventional design which is capable of heating the contents of the chamber 66 to a desired temperature level (discussed below). However, the present invention shall not be limited to this type of heating system which is listed for example purposes. Also included within the interior region 68 of the chamber 66 is mixing means 74 for agitating the contents of the chamber 66 so that a homogenous chemical treatment mixture can be produced. In the present embodiment, the mixing means 74 will consist of a conventional motor driven blade-type agitator unit 76 schematically illustrated in FIG. 1. While this type of apparatus is preferred, other mixing systems known in the art may also be used, with the present invention not being limited to any particular agitation system.

Finally, to control the flow of the chemical treatment mixture through the conduit 60 and into the passageway 14 of the conduit member 12, an optional in-line valve 78 and pump 79 (e.g. a conventional piston or diaphragm pump) may be used if needed which are both of a type known in the art for fluid transfer. As illustrated, these components are located between the first end 62 and the second end 64 of the conduit 60. An important part of the system 10 involves the chemical mixture which is used to treat the selected textile materials in accordance with the present invention. With reference to FIG. 1, the interior region 68 of the chamber 66 includes a supply of a chemical treatment mixture which is generally designated at reference number 100. In a preferred embodiment, the mixture 100 will consist of two main components with a third optional ingredient. The first main component involves a selected textile treatment composition. The term "textile treatment composition" as used herein shall encompass any chemical material in solid, liquid, or gaseous form which is used to treat, modify, protect, or otherwise alter textile materials to produce one or more desired characteristics. In this regard, the present invention shall not be limited to the use of any particular textile treatment compositions. However, in a preferred embodiment, two main textile treatment compositions are of primary interest. These compositions include (1) sizing agents; and (2) textile dyes. Both of these compositions will now be discussed.

As previously indicated, a procedure known as "sizing" is used to facilitate the production of woven textile products. Sizing is employed to ensure that each of the yarn strands is as smooth and strong as possible. As a result, the strands are more easily processed in subsequent portions of the weaving system. Furthermore, sizing is required to reduce the number of yarn strands that break during the high-speed weaving process. The breakage of a yarn strand typically occurs due to mechanical failure of the strand caused by snagging with adjacent strands. Abrasion or snagging caused by adjacent strands results when each strand includes a substantial number of individual fibers which extend outwardly from the strand instead of being engaged in a tight arrangement around the strand surface. Sizing is employed to produce individual yarn strands having a smooth and even surface with a minimal number of extraneous, outwardly-extending fibers.

The chemical treatment mixture 100 may involve many different commercially available sizing agents. While the present invention shall not be limited to any specific sizing agent, exemplary sizing compositions will include the following materials: acrylates, acrylic acid monomers, acrylic acid polymers, ammonium salts of polyacrylic acid, ammonium salts of acrylic copolymers, polyacrylates, polyacrylic acid, sodium salts of acrylic copolymers, polyesters, polyvinyl chloride, polyvinyl acetate, polyvinyl alcohol, carboxymethyl cellulose, hydroxyethyl cellulose, sodium alginate, textilose, interpolymers of maleic anhydride, and various starch compositions (e.g. carboxymethyl starches, corn starch, and potato starch). These compositions are commercially available from numerous sources including Allied Colloids, Inc. of Suffolk, Va. (U.S.A.), National Starch and Chemical Corp. of Bridgewater, N.J. (U.S.A.), Hoechst Celanese Corp. of Charlotte, N.C. (U.S.A.), BASF Corp. of Parsippany, N.J. (U.S.A.), and Air Products and Chemicals, Inc. of Allentown, Pa. (U.S.A.).

The other textile treatment composition of primary importance is a selected textile dye which is used to impart a desired color to the yarn strand. Many different dye compositions may be employed for this purpose, with the present invention not being limited to any specific dye materials. Exemplary textile dyes suitable for use in the system 10 include the following representative compositions: CI Direct Red 118, CI Direct Orange 75, CI Direct Red 23, CI Direct Orange 18, CI Direct Yellow 49, CI Direct Red 16, CI Direct Red 81, CI Direct Red 110, CI Direct Blue 67, CI Direct Blue 43, CI Direct Green 26, CI Direct Green 28, CI Reactive Yellow 4, CI Reactive Blue 40, CI Reactive Orange 1, CI Reactive Red 12, CI Vat Black 1, CI Vat Red 1, CI Vat Yellow 20, CI Vat Violet 13, CI Vat Brown 44, CI Pigment Blue 15, CI Reactive Brown 1, CI Reactive Blue 4, and CI Reactive Blue 7. These materials are described in the Color Index, Vol. 4, 3rd ed., published by The Society of Dyers and Colourists, Yorkshire, England (1971) which is a standard reference that is well known in the art. In addition, the above-listed compositions are commercially available from numerous sources including the GAF Corporation of Wayne, N.J. (U.S.A.), Sandoz Chemicals Corp. of Charlotte, N.C. (U.S.A.), and Ciba-Geigy Corp. of Greensboro, N.C. (U.S.A.).

The second main component in the chemical treatment mixture 100 is known as a "carrier medium" which is used to transport the textile treatment composition into the system 10. Many different types of carrier media may be used in the mixture 100, and the present invention shall not be limited to any specific composition for this purpose. In accordance with the invention, the selected carrier medium may consist of (1) a supercritical fluid; or (2) a liquified gas. The term "supercritical fluid" as used herein involves a fluid material (e.g. a liquid or a gas) which has been raised simultaneously above both its critical temperature and critical pressure. The term "critical temperature" involves the temperature above which a gas cannot be liquified by pressure alone, while the term "critical pressure" involves the maximum pressure under which a substance may exist as a gas phase in equilibrium with a liquid phase at the critical temperature. A supercritical fluid cannot be liquified no matter how much pressure is applied to the fluid. As a result, a supercritical fluid consists essentially of a very dense gas. To produce a supercritical fluid, a selected chemical composition (e.g. a liquid or a gas) is first chosen, followed by heating of the composition under pressure until the temperature and pressurization levels associated with the composition have both been raised simultaneously above critical values. Critical temperature and pressure levels for a wide variety of materials are listed in many standard treatises, including the *Handbook of Chemistry and Physics*, CRC Press, Cleveland, Ohio, p. F-79 to F-80, 55th ed. (1974–1975) which is incorporated herein by reference. Exemplary and preferred compositions suitable for use within the mixture 100 as a supercritical fluid (e.g. a carrier medium) include the following materials listed in TABLE I below:

TABLE I

| COMPOSITION | CRITICAL TEMP. (°C.) | CRITICAL PRESSURE (atm) |
|---|---|---|
| $CO_2$ | 31 | 72.9 |
| $H_2O$ | 374.1 | 218.3 |
| methane | −82.1 | 45.8 |
| ethane | 32.2 | 48.2 |
| propane | 96.8 | 42 |
| n-pentane | 196.6 | 33.3 |
| ethylene | 9.9 | 50.5 |
| methanol | 240 | 78.5 |

TABLE I-continued

| COMPOSITION | CRITICAL TEMP. (°C.) | CRITICAL PRESSURE (atm) |
|---|---|---|
| ethanol | 243 | 63 |
| isopropanol | 235 | 47 |
| isobutanol | 277 | 42.4 |
| toluene | 320.8 | 41.6 |
| ammonia | 132.5 | 112.5 |
| nitrous oxide | 36.5 | 71.7 |

As noted above, the present invention shall not be limited to any particular composition as the supercritical fluid, with the materials listed above involving representative examples. Other compositions may be employed for this purpose which are converted into supercritical fluids by raising the temperature and pressure levels of the selected compositions above critical values in a simultaneous manner as previously discussed. Also, mixtures of more than one supercritical fluid may be used, provided that the necessary temperature and pressure conditions are maintained so that the selected fluid mixture remains in a supercritical state. In addition, the selection of any given supercritical fluid will be undertaken in accordance with preliminary pilot studies involving a number of factors including the solubility of the desired textile treatment composition within the fluid material of interest. While all of the materials listed above in TABLE I can be used to create a supercritical fluid in accordance with the invention, preliminary testing will determine which combinations are best for a given situation.

Preparation of the supercritical fluid (and the mixture 100) may take place directly within the interior region 68 of the main chamber 66. As previously indicated, the chamber 66 will preferably be of a type that is capable of withstanding the pressure and temperature levels which are necessary to generate both the supercritical fluid and the mixture 100. To produce the mixture 100, a chemical composition is first selected for use as the supercritical fluid. This material, along with a desired textile treatment composition (e.g. a sizing agent or a textile dye) is supplied to the interior region 68 of the chamber 66. Thereafter, these ingredients are heated within the chamber 66 (which is sealed) until critical temperature and pressure levels are achieved. The values associated with these parameters will depend on the specific chemical composition being used as the carrier medium as indicated above in TABLE I. Heating is accomplished using the heating means 70 described above (e.g. the electrical coil-type resistive heating element 72 or other comparable system). During this process, the textile treatment composition will vaporize and otherwise dissolve within the gaseous supercritical fluid. The dissolution process and other physical reactions which produce the mixture 100 in the chamber 66 are highly complex and not yet entirely understood. To properly manufacture the completed gaseous mixture 100, the mixing means 74 (e.g. the blade-type agitator unit 76 or other comparable system) will be activated in order to mix the above-listed ingredients. If the blade-type agitator unit 76 is used, it will preferably operate at a rotational speed of about 100–600 RPM.

Preparation of the mixture 100 as described above will typically take about 60–180 minutes. The final mixture 100 will consist of a dense gas in which the textile treatment composition is dissolved within the supercritical fluid. It should also be noted that preparation of the supercritical fluid may be undertaken in a separate containment vessel 102 having auxiliary heating means 104 therein (e.g. an electrical coil-type resistive heating element 106 or other comparable system) shown in phantom lines in FIG. 1. The containment vessel 102 is operatively connected to the chamber 66 using a tubular conduit 110 having a first end 112 and a second end 114. The first end 112 is connected to the containment vessel 102, with the second end 114 being connected to the main chamber 66. To produce the supercritical fluid within the containment vessel 102, the same steps and procedures are taken as described above regarding preparation of the supercritical fluid with the chamber 66. If produced within the containment vessel 102, the supercritical fluid is delivered to the chamber 66 using the conduit 110. The supercritical fluid inside the chamber 66 is then mixed with the textile treatment composition using the mixing means 74 (e.g. the blade-type agitator unit 76). Necessary critical temperature and pressure levels are maintained within the chamber 66 using the heating means 70 described above (e.g. the electrical coil-type resistive heating element 72). In this regard, both of the methods described above involving preparation of the supercritical fluid and mixture 100 shall be considered equivalent in function and result.

The other composition suitable for use as the carrier medium involves a liquified gas which is mixed with the textile treatment composition (and any other optional ingredients) inside the chamber 66 to produce the mixture 100. In this embodiment, the completed mixture 100 prior to use within the conduit member 12 will be in liquid form. The term "liquified gas" is basically defined to involve any gas that has been subjected to low enough temperatures and high enough pressures to convert the gas into a liquid. The necessary temperatures and pressures which are sufficient to liquify a given gas will be determined on a case-by-case basis, depending on the specific gas under consideration. Many different liquified gases may be used in the present invention which shall not be limited to any specific composition for this purpose. The specific liquified gas to be selected for a given application will be determined in accordance with preliminary experiments involving many factors including the solubility characteristics of the selected textile treatment composition. Exemplary liquified gases suitable for use in the processing system 10 include but are not limited to the following gases in liquid form: $CO_2$, methane, ethane, propane, ethylene, nitrous oxide, and sulfur hexafluoride. Pre-manufactured liquified gas products which can be used to produce the mixture 100 may be purchased from many commercial sources. These sources include Air Products and Chemicals, Inc. of Allentown, Pa. (U.S.A.), Matheson Gas Products, Inc. of Secaucus, N.J. (U.S.A.), Liquid Carbonics, Inc. of Oak Brook, Ill. (U.S.A.), and Liquid Air Corporation of Walnut Creek, Calif. (U.S.A.). In addition, liquified gas compositions suitable for use in the present invention may be produced directly within the system 10 when needed. Production of the desired liquified gas in situ within the main chamber 66 (or within the containment vessel 102 for subsequent delivery to the chamber 66) will involve a conventional procedure in which the selected gas is pressurized to necessary levels while removing the resulting heat which is generated during this process. The necessary pressure and temperature levels will depend on the gas being liquified which can be determined in accordance with preliminary testing on the gas materials of interest. By reducing the temperature of the selected gas below the critical level (see TABLE I) and adjusting the pressure level of the gas to a predetermined level (which depends on the gas under consideration), the selected gas may be liquified in a conventional manner. The liquified gas product is then combined with the textile treatment composition in the same manner described above regarding the use of a supercritical fluid as the carrier medium. The completed mixture 100 in this embodiment of the invention will be in liquid form compared with the gaseous mixture 100 which is produced using a supercritical fluid. The mixture 100 is thereafter retained within the main chamber 66 until needed, with the necessary temperature and pressure levels being maintained by the heating means 70. As discussed below, all forms of the mixture 100 involve high-pressure (pressurized) carrier media having the textile treatment composition dissolved therein. When the high-pressure mixture 100 is introduced into the constricted region 44 of the passageway 14 (which involves a region of low pressure due to the constricted nature of the region 44), the mixture 100 undergoes a rapid expansion and decrease in pressure within the constricted region 44 and downstream therefrom (e.g. toward the second end portion 22). As a result, the textile treatment composition will precipitate in liquid or solid form directly from the mixture 100 onto the moving yarn strand in a highly efficient manner. Further information regarding this aspect of the present invention will be provided below.

In addition to the carrier medium and the textile treatment composition within the mixture 100, an optional third ingredient may also be added. This third ingredient will involve a composition known as a "solvent" which is combined with the above-listed ingredients to improve the solubility of the textile treatment composition within the carrier medium. The use of a solvent in this manner is especially important when a sizing agent is employed as the textile treatment composition. Determinations as to whether a solvent will be necessary are undertaken on a case-by-case basis in accordance with preliminary pilot solubility tests involving the selected textile treatment composition and carrier medium. Exemplary and preferred solvent materials which may be used include water, methanol, ethanol, isopropanol, toluene, and benzene. If a solvent is needed, it is combined with the textile treatment composition and the carrier medium inside the chamber 66. The resulting 3-part mixture 100 is then processed as described above, with the mixture 100 being heated and mixed using the heating means 70 and mixing means 74.

In a preferred embodiment, the completed treatment mixture 100 will be formulated as described above to have the following ingredient proportions: about 80–98% by weight carrier medium (supercritical fluid or liquified gas), about 1–5% by weight textile treatment composition (e.g. sizing agent or textile dye), and about 0–15% by weight solvent. While these values are preferred in the present invention, they may be varied in accordance with a variety of experimentally determined factors, including the type of textile products being treated. The completed mixture 100 is held within the main chamber 66 until needed, and is maintained at the necessary temperature and pressure levels using the heating means 70 as previously discussed. Prior to entry into the passageway 14 as described below, the mixture 100 will typically be maintained at a pressure level of about 1000–10,000 psi and a temperature of about 90°–590° F. The specific temperature and pressure levels within these broad ranges will depend on the type of mixture 100 being used in the system 10, its specific components, and whether it is in a gaseous or liquid state. Accordingly, the specific parameters to be used in any given situation will be determined by preliminary analysis prior to full-scale textile treatment.

With reference to FIG. 1, an exemplary yarn strand 120 is shown. The term "yarn strand" as used herein shall involve a single thread of textile material consisting of multiple hair-like fibers grouped together. As indicated above, the passageway 14 and its various components (e.g. the first end portion 20, the second end portion 22, the medial portion 24, and the constricted region 44) are sized to allowed the yarn strand 120 to move through the passageway 14 without frictionally engaging the side wall 16 of the conduit member 12. Many different types of natural and synthetic textile materials may be used to produce the yarn strand, with the present invention being applicable to all types. Likewise, the system 10 will function effectively in the treatment of all different strand sizes (thicknesses), provided that the components of the system 10 are configured to accommodate the selected strand. Representative compositions which may be used to produce the yarn strand 120 illustrated in FIG. 1 include but are not limited to cotton, linen, polyester, nylon, rayon, dacron, cotton/polyester blends (e.g. 50% cotton and 50% polyester) and other comparable materials. While the system 10 shall not be limited to any particular diameter associated with the yarn strand 120, the strand 120 will typically have a diameter range of about 0.004–0.038 in. in the present embodiment. As further discussed in the "Operation" section below, the strand 120 will rapidly move through the passageway 14 during treatment so that large quantities of yarn may be processed in a minimal amount of time. In a preferred embodiment, the yarn strand 120 will move through the system 10 at about 500–1000 yards/minute, although this rate may be varied in accordance with many factors including the type of yarn being processed and the specific configuration of the system 10.

The system 10 may also include a number of additional components and sub-systems which, while optional, may enhance the efficiency of the treatment process. The use of one or more of these items will depend on a variety of factors as determined by preliminary testing on the specific yarn materials and chemical treatment mixture 100 of interest. With reference to FIG. 1, the conduit member 12 may include at least one and preferably multiple, evenly-spaced rear baffle members 150 which are vertically oriented within the second end portion 22 of the passageway 14. Each of the baffle members 150 is of circular design in the embodiment of FIG. 1, and will optimally be constructed from the same materials used to produce the conduit member 12 (e.g. stainless steel). The baffle members 150 are each secured to the interior surface 152 of the side wall 16 in a conventional manner by welding, adhesive affixation, or other standard process depending on the construction materials being used. Likewise, each baffle member 150 is sized for precise engagement within the passageway 14 so that the outer peripheral edge thereof comes in contact with the interior surface 152 of the side wall 16 along the entire circumference of the baffle member 150.

With continued reference to FIG. 1, each baffle member 150 further includes an opening 154 therein which, in a preferred embodiment, will have the same size and diameter as the openings 34, 42 in the end plates 30, 36. In addition, the opening 154 in each baffle member 150 will have a diameter sufficient to allow the yarn strand 120 to pass therethrough without frictionally engaging the baffle member 150. However, it is likewise preferred that the opening 154 in each baffle member 150 have a diameter which is about the same as the diameter $D_2$ associated with the constricted region 44 as described above. In an exemplary embodiment, the openings 154 in the baffle members 150 will all be of the same size and have a diameter of about 0.006–0.10 inches. Each baffle member 150 is designed and secured in position so that the longitudinal center axis $A_1$ of the passageway 14 will pass through the center of the opening 154.

As indicated above, one or more baffle members 150 may be employed within the system 10. The specific number of baffle members 150 to used in a given situation will depend on many factors including the size and desired capacity of the system 10. In the exemplary embodiment of FIG. 1, four separate baffle members 150 are provided within the second end portion 22 which create four individual rear chambers 156. The chambers 156 and baffle members 150 cooperate to provide substantial benefits in the system 10. Specifically, these components (particularly the first two chambers 156 adjacent the constricted region 44) collectively form a "pressure let-down region" 160 within the second end portion 22. The region 160 facilitates the rapid drying of the yarn strand 120 after treatment and during movement of the strand 120 through the passageway 14. While the physical interactions which cause drying within the pressure let-down region 160 are not entirely understood, it is believed that enhanced drying occurs due to progressive pressure decreases within the passageway 14 which take place as the yarn strand 120 rapidly moves through the narrow-diameter openings 154 in the baffle members 150. These decreases in pressure promote enhanced vaporization of residual amounts of the carrier medium from the surface of the yarn strand 120 as noted above. The desired decreases in pressure within the pressure let-down region 160 may be initiated and otherwise enhanced through the use of a selected optional pressure regulator unit (e.g. a commercially-available pressure let-down valve) positioned within one of the outlet ports in the conduit member 12 as discussed further below.

While the baffle members 150 provide substantial benefits in the second end portion 22 of the passageway 14, one or more evenly-spaced front baffle members 162 may likewise be positioned in a vertical orientation within the first end portion 20 of the passageway 14 as illustrated in FIG. 1. The baffle members 162 in the first end portion 20 will have the same shape, size, composition, and orientation as the baffle members 150 in the second end portion 22 as previously discussed. For example, each baffle member 162 is sized for precise engagement within the passageway 14 so that the outer peripheral edge thereof comes in contact with the interior surface 152 of the side wall 16 along the entire circumference of the baffle member 162. Each of the baffle members 162 further includes an opening 164 therein which is of the same size and location as the opening 154 in each baffle member 150. The openings 164 in the baffle members 162 will each have a diameter sufficient to allow the yarn strand 120 to pass therethrough without frictionally engaging the baffle members 162. However, it is likewise preferred that the opening 164 in each baffle member 162 have a diameter which is about the same as the diameter $D_2$ associated with the constricted region 44 as described above. In an exemplary embodiment, the openings 164 in the baffle members 162 will all be of the same size and have a diameter of about 0.006–0.10 inches. Each baffle member 162 is designed and secured in position in the same manner as the baffle members 150 so that the longitudinal center axis $A_1$ of the passageway 14 will pass through the center of the opening 164. In the exemplary embodiment of FIG. 1, three baffle members 162 are provided within the first end portion 20 which create three individual front chambers 166. The baffle members 162 and the front chambers 166 cooperate to improve the operating efficiency of the system 10 by confining the selected carrier medium and textile treatment composition inside the passageway 14 of the conduit member 12. In addition, the baffle members 162 specifically function as pressure barriers which prevent the leakage of materials from the passageway 14 until the removal of such materials is desired as described below. Pressure control exerted by the baffle members 162 in the first end portion 20 may be initiated and otherwise enhanced through the use of a selected optional pressure regulator unit (e.g. a commercially-available pressure let-down valve) positioned within one of the outlet ports in the conduit member 12 as discussed further below.

The processing system 10 may also include a sub-system for introducing at least one optional carrier gas into the passageway 14. The carrier gas is designed to perform many functions. For example, if heated as described below, it assists in rapidly drying the yarn strand 120 after treatment. The carrier gas also facilitates the winding of extraneous yarn fibers around the yarn strand 120 to produce a smooth final product. As illustrated in FIG. 1, a carrier gas inlet port 180 is provided in the side wall 16 of the conduit member 12. The inlet port 180 consists of a bore 182 which, in a preferred embodiment, is positioned at the medial portion 24 of the passageway 14 adjacent to and before the constricted region 44. As a result, the inlet port 180 is in fluid communication with the constructed region 44 as discussed below. The bore 182 passes entirely through the side wall 16 and is designed to allow the delivery of a selected carrier gas directly into the medial portion 24 and constricted region 44 during operation of the system 10. Also provided as schematically shown in FIG. 1 is a tubular conduit 184 having a first end 186 and a second end 190. The first end 186 of the conduit 184 is connected to and within the bore 182, with the second end 190 being connected to a gas storage tank 192 of conventional design. In this manner, the storage tank 192 is directly connected to the inlet port 180. Positioned in-line within the conduit 184 if needed is an optional control valve 194 and pump 196 (e.g. a conventional piston or diaphragm pump) which are both of a type known in the art for gas transfer. Retained within the interior region 198 of the storage tank 192 is a supply of a selected carrier gas 200. Many different gas materials may be used as the carrier gas 200, with the present invention not being limited to any particular gas composition. In a preferred embodiment, the carrier gas 200 will consist of a non-reactive, inert gas which will not react with any of the materials in the chemical treatment mixture 100. Exemplary gases suitable for use in the system 10 as the carrier gas 200 include but are not limited to $CO_2$, Ar, $N_2$, air, and He. Optimum results are achieved from a compatibility standpoint if the carrier gas 200 involves the same composition used in connection with the carrier medium (e.g. the supercritical fluid or liquified gas). For example, if supercritical $CO_2$ is employed as the carrier medium, then best results will be achieved if a $CO_2$ carrier gas is used.

The interior region 198 of the storage tank 192 may also include heating means 202 for increasing the temperature of the carrier gas 200 prior to delivery. The heating means 202 may involve any conventional system suitable for heating inert gaseous materials, including an electrical coil-type resistive heating element 204 or other comparable system. The temperature and pressure levels of the carrier gas 200 upon introduction are not critical, but are preferably about the same as those associated with the chemical treatment mixture 100. Accordingly, preferred temperature and pressure ranges used in connection with the carrier gas 200 will be comparable to those listed above regarding the chemical treatment mixture 100.

A decision to use the carrier gas 200 will depend on a variety of factors, including the configuration of the system 10, the yarn materials being treated, and the content of the chemical treatment mixture 100. If used, the carrier gas 200 can achieve the benefits listed above which include more efficient drying of the yarn strand 120 and the winding of extraneous yarn fibers around the strand 120 as previously discussed.

A further alternative step in the system 10 would involve the introduction of an additional gas (also known as a "seal gas") into the system 10. As shown in FIG. 1, a first gas delivery port 220 is provided within the side wall 16 of the conduit member 12 at the first end portion 20 of the passageway 14. The first gas delivery port 220 consists of a bore 222 which, in a preferred embodiment, is spaced inwardly from the end plate 30 as shown in FIG. 1. In this orientation, the bore 222 is located between the end plate 30 and the gas inlet port 180 associated with the carrier gas 200. The bore 222 passes entirely through the side wall 16 and is designed to allow delivery of a selected seal gas into the first end portion 20 of the passageway 14 during the operation of system 10. Also provided as schematically illustrated in FIG. 1 is a tubular conduit 224 having a first end 226 and a second end 230. The first end 226 of the conduit 224 is connected to and within the bore 222, with the second end 230 being connected to an additional gas containment vessel 232 of conventional design and preferably of the same type used in connection with the carrier gas storage tank 192. In this manner, the containment vessel 232 is directly connected to the port 220. Positioned in-line within the conduit 224 if needed is an optional control valve 234 and pump 236 (e.g. a conventional piston or diaphragm pump) which are both of a type known in the art for gas transfer.

With continued reference to FIG. 1, a second gas delivery port 240 is provided within the side wall 16 of the conduit member 12 at the second end portion 22 of the passageway 14. The second gas delivery port 240 consists of a bore 242 which, in a preferred embodiment, is spaced inwardly from the end plate 36. In this orientation, the bore 242 is located between the end plate 36 and the medial portion 24 of the passageway 14. The bore 242 passes entirely through the side wall 16 and is designed to allow the delivery of a selected seal gas into the second end portion 22 of the passageway 14 during the operation of system 10. Also provided as schematically illustrated in FIG. 1 is a tubular conduit 244 having a first end 246 and a second end 250. The first end 246 of the conduit 244 is connected to and within the bore 242, with the second end 250 being connected to the gas containment vessel 232. In this manner, the containment vessel 232 is directly connected to the port 240. Positioned in-line within the conduit 244 if needed is an optional control valve 252 and pump 254 (e.g. a conventional piston or diaphragm pump) which are both of a type known in the art for gas transfer.

Retained within the interior region 256 of the gas containment vessel 232 is a supply of an additional gas which is used as the seal gas (designated at reference number 260). As discussed below, the seal gas 260 is designed to function as a "seal" or leakage barrier within the passageway 14 by creating back-pressure therein so that leakage of the textile treatment composition and carrier medium through the openings 34, 42 in the end plates 30, 36 is prevented. Many different gas materials may be used as the seal gas 260, with the present invention not being limited to any particular gas composition for this purpose. In a preferred embodiment, the gas 260 will consist of a non-reactive, inert product which will not react with any of the materials in the chemical treatment mixture 100. Exemplary gases suitable for use as the seal gas 260 include but are not limited to $CO_2$, air, Ar, and $N_2$.

The interior region 256 of the containment vessel 232 may also include heating means 262 for increasing the temperature and pressure of the gas 260 prior to delivery. The heating means 262 may involve any conventional system suitable for heating inert gaseous materials, including an electrical coil-type resistive heating element 264 (FIG. 1) or other comparable system. To achieve optimum results, the pressure level of the seal gas 260 should be greater than existing pressure levels within the passageway 14 at both the first end portion 20 and the second end portion 22. By conducting preliminary tests to determine the internal pressure levels within the first and second end portions 20, 22, the desired pressure level of the gas 260 can be determined. While exact pressure and temperature levels associated with the gas 260 will need to be individually determined on a case-by-case basis, it is anticipated that, for most purposes, the seal gas 260 will be delivered to the passageway 14 at a temperature of about 60°–200° F. and a pressure of about 10–200 psi. In a preferred embodiment, the specific pressure levels of the seal gas 260 for any given situation will be about 1–5% greater than the average pressure values within the first and second end portions 20, 22 of the passageway 14.

As noted above, use of the seal gas 260 at a higher pressure level compared with the pressure levels at the first and second end portions 20, 22 will create a sufficient degree of back-pressure inside the passageway 14 to create a leakage barrier or "seal" therein which prevents the introduction of air into the passageway 14 via the openings 34, 42 in the end plates 30, 36. The seal gas 260 also prevents the leakage of materials out of the system 10. Specifically, introduction of the seal gas 260 in foregoing manner (e.g. at higher pressure levels) will block movement of the textile treatment composition and carrier medium toward the end plates 30, 36 and prevent leakage of these materials out of the passageway 14 through openings 34, 42. A decision to use the seal gas 260 will depend on numerous factors, including the configuration of system 10, the yarn materials being treated, and the content of the chemical treatment mixture 100 as determined by initial investigations prior to full-scale operation of the system 10.

Finally, the conduit member 12 may include a plurality of outlets for removing, collecting, and/or recycling various gaseous components which are present within the passageway 14. Positioned between the end plate 30 and the first gas delivery port 220 is a first outlet port 270 in the form of a bore 272 through the side wall 16. Likewise, located between the end plate 36 and the second gas delivery port 240 is a second outlet port 274 in the form of a bore 276 through the side wall 16. The first and second outlet ports 270, 274 allow the rapid removal of seal gas 260 from the passageway 14 at desired intervals. The removed seal gas 260 can thereafter be processed and recycled for subsequent reuse within the system 10 or discarded if desired. In addition, the first outlet port 270 may include an optional regulator valve 277 therein (e.g. a commercially-available pressure let-down valve of conventional design) which can be used to control the pressure within the first end portion 20 of the passageway 14 and selectively allow the removal of seal gas 260 as previously discussed. As a result, pressure levels within the first end portion 20 of the passageway 14 can be manipulated so that gaseous materials (e.g. the seal gas) may be retained within the system 10 until withdrawal is desired. The valve 277 can also be used in cooperation with the front baffle members 162 to provide the benefits listed above. Likewise, to control the flow of materials through the second outlet port 274 and regulate pressure levels within the second end portion 22, the bore 276 may include an optional regulator valve 278 of the same type as valve 277.

In a similar manner, a third outlet port 280 in the form of a bore 282 is provided between the carrier gas inlet port 180 and the first gas delivery port 220. As shown in FIG. 1, the bore 282 passes entirely through the side wall 16 at the first end portion 20. Likewise, a fourth outlet port 284 in the form of a bore 286 is provided between the second gas delivery port 240 and the medial portion 24 of the passageway 14. The bore 286 also passes entirely through the side wall 16. The third and fourth outlet ports 280, 284 allow the carrier medium used in the mixture 100 (e.g. the chemical composition used to produce the medium) to be removed from the passageway 14 at desired intervals. After delivery of the mixture 100 to the constricted region 44 and expansion of the mixture 100, the carrier medium will reside within the passageway 14 in the form of a gas or liquid which can be removed from the system 10 through the third and fourth outlet ports 280, 284. In addition, the third outlet port 280 may include an optional regulator valve 298 therein. Likewise, the fourth outlet port 284 may include an optional regulator valve 299 therein as illustrated. The valves 298, 299 will preferably be of the same type as valve 277 described above. The valves 298, 299 may be used to control the pressure within the first and second end portions 20, 22 of the passageway 14. Likewise, as discussed below, they may also be used to control the flow of materials out of the passageway at desired intervals. The valve 299 can specifically be used in cooperation with the rear baffle members 150 to provide the benefits listed above.

B. Operation

In accordance with the present invention, the system 10 may be used in a highly efficient manner to produce a chemically-treated yarn strand. To process the yarn strand 120 shown in FIG. 1, the strand 120 is first introduced into the passageway 14 and continuously moved therethrough at the rate indicated above (e.g. about 500–1000 yards/minute in a preferred embodiment). In FIG. 1, the strand 120 is moving in the direction of arrow 300. Next, the chemical treatment mixture 100 (prepared as described above) is introduced into the constricted region 44 of the passageway 14. In the illustrated embodiment, the pressurized mixture 100 (in gaseous or liquid form) passes from the interior region 68 of the main chamber 66 through the conduit 60 and nozzle 58. The mixture 100 then enters the bore 52 through the medial portion 24 of the passageway 14 as illustrated in FIG. 1. In a preferred embodiment, if a supercritical fluid is used as the carrier medium in the mixture 100, it will be introduced into the passageway 14 at an exemplary flow rate of about 250–500 ml/min. If a liquified gas is used as the carrier medium, it will be introduced into the passageway 14 at a flow rate of about 500–1000 ml/min. However, the present invention shall not be limited to any specific flow rates for the materials delivered into the passageway 14. Flow rates in any given situation will be determined on a case-by-case basis in accordance with preliminary tests on the materials being delivered. As the mixture 100 enters the constricted region 44, it undergoes a rapid expansion due to a significant drop in pressure experienced by the mixture 100 within the constricted region 44 of the passageway 14. As previously noted, the constricted region 44 functions as a venturi which creates a low-pressure zone within the passageway 14. With reference to FIG. 1, the mixture 100 leaves the bore 52 in the direction of arrow 302.

As the mixture 100 experiences a rapid decrease in pressure, the carrier medium will revert to its ambient, natural state. In the case of a liquified gas carrier medium, the medium will change back into a gas. If a supercritical fluid is used, it will (in most cases) revert back to either a gas or liquid, depending on the original state of the chemical composition used to produce the supercritical fluid and temperature conditions within the passageway 14. As a result, the previously-dissolved textile treatment composition (e.g. the sizing agent or dye) will precipitate as a liquid or solid from the mixture 100. Entry of the pressurized mixture 100 into the constricted region 44 as described above will cause the textile treatment composition to be applied in a direct and complete manner to the moving yarn strand 120. Likewise, if the inlet port 50 and bore 52 are oriented at an angle relative to the longitudinal center axis $A_1$ of the passageway 14 (e.g. angle "X" as previously described), the precipitated textile treatment composition will swirl in a helical manner around the strand 120 within the constricted region 44 as shown in FIG. 1 at arrow 304. Swirling of the textile treatment composition in this manner efficiently wraps extraneous, outwardly-extending hair-like yarn fibers around the yarn strand 120. All of these steps produce a treated yarn product 310 (FIG. 1) which is impregnated and evenly coated in a unique manner with the textile treatment composition. The treated yarn product 310 is likewise uniquely characterized by the presence of a highly smooth exterior surface which avoids the problems listed above.

As previously indicated, the constricted region 44 of the passageway 14 performs many important functions including: (1) the formation of a low-pressure zone which facilitates the precipitation and distribution of the textile treatment composition onto the strand 120; and (2) the creation of an environment in which the textile treatment composition will swirl around the strand 120 to provide the benefits listed above. In addition, the structural characteristics of the constricted region 44 prevent premature flashing of the carrier medium used in the mixture 100. If not controlled, premature flashing will cause expansion of the yarn strand 120 and subsequent flaking of the textile treatment composition from the strand 120 (especially if sizing agents are involved).

The treated yarn product 310 will then be dried as it passes through the openings 154 in the baffle members 150 within the pressure let-down region 160 at the second end portion 22. As indicated above, drying of the strand 120 occurs as it passes through the region 160 due to controlled reductions in pressure caused by the baffle members 150 which rapidly vaporize the textile treatment composition on the yarn. After drying as described above, the treated yarn product 310 will continue moving through the passageway 14, and will ultimately leave the system 10 via the opening 42 in the second end plate 36. The yarn product 310 can then be further processed in accordance with standard textile manufacturing techniques.

In the embodiment of FIG. 1, the carrier gas 200 (if used) will be introduced into the medial portion 24 simultaneously with the introduction of the mixture 100 into the constricted region 44. Specifically, the carrier gas 200 will pass from the interior region 198 of the gas storage tank 192 through the conduit 184 and into the bore 182 associated with the gas inlet port 180. The carrier gas 200 will enter the medial portion 24 of the passageway 14 at a preferred flow rate of about 25–50 ml/min. and travel in the direction of arrow 312. As a result, the carrier gas 200 will pass over and around the strand 120. The gas 200 will provide numerous benefits as described above, including an increase in the drying rate of the treated yarn product 310. Introduction of the carrier gas 200 into the constricted region 44 will also facilitate the fiber-winding process in which individual, outwardly-extending yarn fibers are wrapped around the strand 120.

Finally, the seal gas 260 (if used) is introduced into at least one of the first and second end portions 20, 22 simultaneously with the addition of the mixture 100 as described above. In the preferred embodiment of FIG. 1, the seal gas 260 is provided to both the first and second end portions 20, 22 at an exemplary flow rate of about 10–40 ml/min. The gas 260 (which is maintained at a higher pressure level compared with the other materials inside the passageway 14 as discussed above) is delivered from the interior region 256 of the containment vessel 232 through the conduit 224 to the bore 222 associated with the first gas delivery port 220. The gas 260 thereafter enters the first end portion 20 of the passageway 14 in the direction of arrow 314. Simultaneously, the gas 260 is delivered from the interior region 256 of the containment vessel 232 through the conduit 244 to the bore 242 associated with the second gas delivery port 240. The gas 260 thereafter enters the second end portion 22 of the passageway 14 in the direction of arrow 316. As noted above, the gas 260 is designed to create back-pressure within the system 10 which acts as a barrier or "seal" to avoid the entry of air into the passageway 14 and to likewise prevent the leakage of materials out of the system 10 via the end plates 30, 36. Introduction of the seal gas 260 in the foregoing manner will block movement of the textile treatment composition, the carrier medium, and the like toward the end plates 30, 36. This process prevents the leakage of these materials out of the passageway 14 via the openings 34, 42 in the end plates 30, 36. As a result, materials within the system 10 can be conserved and used with a maximum degree of efficiency.

As previously described, compositions within the passageway 14 may be removed at desired intervals for recycling or other purposes. The seal gas 260 may be withdrawn from the first end portion 20 of the passageway 14 through the bore 272 (and valve 277) associated with the first outlet port 270. Likewise, the gas 260 may be removed from the second end portion 22 of the passageway 14 through the bore 276 (and valve 278) associated with the second outlet port 274. The gas 260 may then be recycled for subsequent reuse within the system 10 or discarded. Other materials in the passageway 14 including remaining amounts of the carrier medium (e.g. the chemical composition used to generate the carrier medium) can be withdrawn from the first end portion 20 of the passageway 14 through the bore 282 associated with the third outlet port 280. In a similar manner, these materials can be removed from the second end portion 22 of the passageway 14 through the bore 286 associated with the fourth outlet port 284. The removed compositions can thereafter be subjected to conventional separation and recycling procedures for reuse within the system 10 or discarded if desired.

Regarding the optional removal and recycling of the chemical composition associated with the carrier medium, an exemplary sub-system for accomplishing this goal is illustrated in FIG. 1. As stated above, the chemical composition used to produce the carrier medium will reside within the passageway 14 of the conduit member 12 in the form of a gas or liquid, depending on the particular chemical composition under consideration. Recycling is of particular value when a gaseous chemical composition is involved (e.g. $CO_2$), and when the other materials in the system 10 (e.g. the carrier gas 200 and the seal gas 260) are the same as the chemical composition used to produce the carrier medium. To accomplish recycling in an exemplary embodiment, a tubular conduit 350 is provided having a first end 352 and a second end 354. The first end 352 is operatively connected to and within the bore 282 associated with the third outlet port 280. The second end 354 is connected to the main chamber 66 and in fluid communication with the interior region 68 of the chamber 66. In addition, another tubular conduit 358 is provided which includes a first end 360 and a second end 362. The first end 360 is operatively connected to and within the bore 286 associated with the fourth outlet port 284 as illustrated. The second end 362 of the conduit 358 is connected to the conduit 350 at an intermediate position designated at reference number 364. In this manner, the conduit 358 is in fluid communication with the conduit 350 at position 364. Using the conduits 350, 358, the chemical composition associated with the carrier medium can be transferred from the passageway 14, through outlet ports 280, 284 (and valves 298, 299) back into the chamber 66 for reuse in treating additional quantities of yarn which enter the system 10. As a further note, the recycled chemical composition may be transferred into the containment vessel 102 for reuse within the system 10 instead of being directly transferred into the main chamber 66. This procedure (which shall be deemed equivalent to the process described above involving delivery of the composition into the main chamber 66) will be accomplished by directly connecting the second end 354 of the conduit 350 to the vessel 102 as illustrated in FIG. 1 in phantom lines. After heating and pressurization to produce the supercritical fluid within the vessel 102, the treated chemical composition will then be routed out of the vessel 102 and into the main chamber 66 via conduit 110. Both of the foregoing procedures shall be deemed equivalent because the recycled chemical composition will ultimately end up in the main chamber 66 whether or not it first passes into the vessel 102 as an intermediate step.

Many different components and devices may be used to effectively transfer the chemical composition associated with the carrier medium through the conduits 350, 358 and back into the chamber 66 (or vessel 102). In this regard, the present invention shall not be limited to any particular sub-systems or components for this purpose. The selection of these items will vary in view of the particular compositions being transferred as determined by preliminary testing. For example, it is preferred in most situations (especially those involving gaseous materials) that the conduit 350 include pumps 368, 369 of conventional design (e.g. conventional piston or diaphragm pumps) which are used to move the desired compositions through the conduits 350, 358 and increase the pressure of the compositions if desired. The number of pumps to be used in a given situation will depend on the size and complexity of the system 10. In addition, an optional chiller unit 370 and/or heater unit 372 may be selectively positioned within the conduit 350 as illustrated in FIG. 1 to heat and cool (e.g. condense) the composition of interest as desired. An exemplary chiller unit 370 will consist of a conventional coil-type refrigeration system, while a representative heater unit 372 will involve a standard resistance-type electrical heating coil apparatus. However, the present invention shall not be limited to these particular systems, or any specific location regarding the chiller unit 370 and heater unit 372. For example, a single heat pump of conventional design may be used instead of the separate chiller unit 370 and heater unit 372, with the chilling and heating functions described above taking place within separate sections of the heat pump. This type of system could result in substantial energy savings. In addition, other sub-systems may be employed to facilitate the recycling process including a purging system (not shown) associated with the chiller unit 370 which is designed to remove non-condensible by-products from the chiller unit 370 when gaseous compositions are being condensed within the unit 370. Likewise, separatory systems known in the art (not shown) may be employed within the conduit 350 for separating and removing unwanted materials from the composition being recycled. It should also be noted that the conduit member 12 may include other outlet ports in addition to the third and fourth outlet ports 280, 284 to further facilitate removal of the chemical composition associated with the carrier medium from the passageway 14 if desired.

The configuration of components illustrated in FIG. 1 is ideally suited to the recovery and recycling of compositions in gaseous form which are associated with the carrier medium (e.g. $CO_2$). In the system 10, if $CO_2$ is involved as both a carrier medium and seal gas 260 (which are preferred compositions in the present case), the $CO_2$ gas is initially withdrawn from the passageway 14 through outlet ports 280, 284 (and valves 298, 299), followed by passage of the gas into the conduits 350, 358. Movement of the gas into and through conduits 350, 358 is accomplished by the pump 368 and/or the pressure differential (if any) between the passageway 14 and the conduits 350, 358. Thereafter, the gas enters the chiller unit 370 where it is liquified, followed by pressurization of the liquified gas to a desired level (depending on the particular materials under consideration) by the pump 369. The liquified gas is then routed into the heater unit 372 where it is heated as desired (again depending on the compositions being treated). Finally, the heated product is transferred into the chamber 66 (or vessel 102) for subsequent reuse as noted above. It is important to emphasize that the present invention shall not be limited to the recycling system described above and illustrated in FIG. 1 which is provided for example purposes. Other recycling systems using different components and configurations may be used, depending on the specific materials to be recycled. The recycling system described above may also be used in substantially the same manner to remove liquid materials from the passageway 14 if liquid chemical compositions are initially employed to produce the carrier medium. Certain modifications to the recycling system may be necessary if liquid compositions are involved, with such modifications being determined by preliminary pilot testing.

EXAMPLE

In accordance with the present invention, tests were conducted using the methods and components described above. Specifically, the system 10 as illustrated in FIG. 1 was employed. The yarn strand treated in this Example involved a English cotton count number 35 yarn made from 50% cotton and 50% polyester. Two different chemical treatment mixtures were tested. The first mixture contained 94% by weight supercritical $CO_2$ (in the form of a dense gas) as the carrier medium, 4.0% by weight methanol as a solvent, and 2% by weight polyvinyl alcohol (average molecular weight=30,000–70,000) as a sizing agent/textile treatment composition. The second mixture contained 94% by weight supercritical $CO_2$ (in the form of a dense gas) as the carrier medium, 4.0% by weight methanol as a solvent, and 2% by weight hydroxyethyl starch as a sizing agent/textile treatment composition. Both of these mixtures were maintained at a temperature of between 210°–220° F. and a pressure of 5000 psig. A carrier gas and seal gas as discussed above were not used. The application of both mixtures to the test yarn was accomplished using the methods, procedures, and equipment described above (e.g. as illustrated in FIG. 1). The yarn strands were effectively covered with the sizing agent in both cases, producing evenly-coated, sized yarn strands with the individual yarn fibers tightly wrapped around each strand. The methods and materials of the present invention were therefore successful in producing a treated yarn product. It should be noted that the claimed invention shall not be limited to the mixtures and other parameters outlined in this test which are set forth for example purposes.

The present invention provides numerous benefits compared with prior methods for applying textile treatment compositions to textile materials. These benefits include but are not limited to: (1) the rapid application of many different compositions using a minimal amount of processing equipment; (2) the more efficient use of textile treatment compositions with reduced waste; (3) a reduction in the required level of system maintenance and cleaning; (4) the ability to more rapidly and efficiently apply textile treatment compositions to a yarn strand while avoiding the problems associated with dipping/immersion methods; and (5) the ability to treat textile products on a mass production basis with a minimal amount of labor and equipment. Accordingly, the claimed invention represents a significant advance in textile processing technology.

Having herein described preferred embodiments of the present invention, it is anticipated that suitable modifications can be made thereto by individuals skilled in the art which will nonetheless remain within the scope of the invention. For example, the specific structural components used in connection with the system 10 as shown in FIG. 1 may be varied as necessary in accordance with many factors including the particular type of yarn being processed and the like. While the system 10 illustrated in FIG. 1 involves a single conduit member 12, the present invention shall likewise cover an embodiment in which a large-scale apparatus is employed having multiple conduit members 12 therein. This type of apparatus would be used to treat a plurality of yarn strands in a simultaneous manner. Accordingly, the present invention will not be limited to any specific processing equipment and shall only be construed in accordance with the following claims:

We claim:

1. A method for applying a textile treatment composition to textile materials comprising the steps of:

providing a treatment apparatus comprising a conduit member, said conduit member comprising at least one passageway passing entirely through said conduit member, said passageway being surrounded by a side wall and comprising a first end portion, a second end portion, and a medial portion between said first end portion and said second end portion, said medial portion comprising at least one section thereof in which said side wall extends inwardly to form a constricted region within said passageway;

passing a yarn strand through said passageway so that said strand moves continuously therethrough; and introducing a chemical treatment mixture into said constricted region of said passageway during movement of said yarn strand through said passageway, said mixture comprising a textile treatment composition dissolved within a carrier medium, said carrier medium being selected from the group consisting of a supercritical fluid and a liquified gas, said carrier medium rapidly expanding when said mixture is introduced into said constricted region of said passageway so that said textile treatment composition within said mixture is precipitated therefrom and applied onto said yarn strand to produce a treated yarn product.

2. The method of claim 1 further comprising the step of introducing a carrier gas into said medial portion of said passageway during said introducing of said chemical treatment mixture into said constricted region of said passageway, said carrier gas passing over and around said yarn strand as it passes through said constricted region to facilitate drying of said strand and wrapping of individual yarn fibers around said strand which would normally extend outwardly from said strand.

3. The method of claim 1 further comprising the step of introducing an additional gas into at least one of said first end portion and said second end portion of said passageway during said introducing of said chemical treatment mixture into said constricted region of said passageway, said additional gas producing back-pressure within said passageway which prevents entry of air into said passageway and prevents leakage of said textile treatment composition and said carrier medium outwardly from said passageway.

4. The method of claim 1 wherein said textile treatment composition is selected from the group consisting of a sizing agent and a textile dye.

5. The method of claim 1 wherein said carrier medium comprises supercritical $CO_2$.

6. The method of claim 1 wherein said chemical treatment mixture further comprises at least one solvent therein for facilitating dissolution of said textile treatment composition into said carrier medium.

7. A method for applying a textile treatment composition to textile materials comprising the steps of:

providing a treatment apparatus comprising a conduit member, said conduit member comprising at least one passageway passing entirely through said conduit member, said passageway being surrounded by a side wall and comprising a first end portion, a second end portion, and a medial portion between said first end portion and said second end portion, said medial portion comprising at least one section thereof in which said side wall extends inwardly to form a constricted region within said passageway, said second end portion of said passageway further comprising at least one baffle member positioned therein, said baffle member comprising an opening therethrough;

passing a yarn strand through said passageway so that said strand moves continuously therethrough;

introducing a chemical treatment mixture into said constricted region of said passageway during movement of said yarn strand through said passageway, said mixture comprising a textile treatment composition dissolved within a carrier medium, said carrier medium being selected from the group consisting of a supercritical fluid and a liquified gas, said carrier medium rapidly expanding when said mixture is introduced into said constricted region of said passageway so that said textile treatment composition within said mixture is precipitated therefrom and applied onto said yarn strand to produce a treated yarn product; and passing said treated yarn product through said opening in said baffle member within said second end portion of said passageway in order to facilitate drying of said yarn product.

8. The method of claim 7 further comprising the step of introducing a carrier gas into said medial portion of said passageway during said introducing of said chemical treatment mixture into said constricted region of said passageway, said carrier gas passing over and around said yarn strand as it passes through said constricted region to facilitate drying of said strand and wrapping of individual yarn fibers around said strand which would normally extend outwardly from said strand.

9. The method of claim 7 further comprising the step of introducing an additional gas into at least one of said first end portion and said second end portion of said passageway during said introducing of said chemical treatment mixture into said constricted region of said passageway, said additional gas producing back-pressure within said passageway which prevents entry of air into said passageway and prevents leakage of said textile treatment composition and said carrier medium outwardly from said passageway.

10. The method of claim 7 wherein said textile treatment composition is selected from the group consisting of a sizing agent and a textile dye.

11. The method of claim 7 wherein said chemical treatment mixture further comprises at least one solvent therein for facilitating dissolution of said textile treatment composition into said carrier medium.

12. A method for applying a textile treatment composition to textile materials comprising the steps of:

providing a treatment apparatus comprising a conduit member, said conduit member comprising at least one passageway passing entirely through said conduit member, said passageway being surrounded by a side wall and comprising a first end portion, a second end portion, and a medial portion between said first end portion and said second end portion, said medial portion comprising at least one section thereof in which said side wall extends inwardly to form a constricted region within said passageway, said passageway further comprising a longitudinal axis therethrough;

passing a yarn strand through said passageway so that said strand moves continuously therethrough; and introducing a chemical treatment mixture into said constricted region of said passageway during movement of said yarn strand through said passageway, said mixture comprising a textile treatment composition dissolved within a carrier medium, said carrier medium being selected from the group consisting of a supercritical fluid and a liquified gas, said mixture being introduced into said passageway at an acute angle relative to said longitudinal axis of said passageway so that individual yarn fibers attached to and extending outwardly from said strand will wrap around said strand during said introducing of said mixture into said passageway, said carrier medium rapidly expanding when said mixture is introduced into said constricted region of said passageway so that said textile treatment composition within said mixture is precipitated therefrom and applied onto said yarn strand to produce a treated yarn product.

13. The method of claim 12 further comprising the step of introducing a carrier gas into said medial portion of said passageway during said introducing of said chemical treatment mixture into said constricted region of said passageway, said carrier gas passing over and around said yarn strand as it passes through said constricted region to facilitate drying of said strand and further wrapping of said individual yarn fibers around said strand.

14. The method of claim 12 further comprising the step of introducing an additional gas into at least one of said first end portion and said second end portion of said passageway during said introducing of said chemical treatment mixture into said constricted region of said passageway, said additional gas producing back-pressure within said passageway which prevents entry of air into said passageway and prevents leakage of said textile treatment composition and said carrier medium outwardly from said passageway.

15. The method of claim 12 wherein said textile treatment composition is selected from the group consisting of a sizing agent and a textile dye.

16. The method of claim 12 wherein said chemical treatment mixture further comprises at least one solvent therein for facilitating dissolution of said textile treatment composition into said carrier medium.

17. A method for applying a textile treatment composition to textile materials comprising the steps of:

providing a treatment apparatus comprising a conduit member, said conduit member comprising at least one passageway passing entirely through said conduit member, said passageway being surrounded by a side wall and comprising a first end portion, a second end portion, a medial portion between said first end portion and said second end portion, and a longitudinal axis therethrough, said medial portion comprising at least one section thereof in which said side wall extends inwardly to form a constricted region within said passageway, said second end portion of said passageway further comprising at least one baffle member positioned therein, said baffle member comprising an opening therethrough;

passing a yarn strand through said passageway so that said strand moves continuously therethrough;

introducing a chemical treatment mixture into said constricted region of said passageway during movement of said yarn strand through said passageway, said mixture comprising a textile treatment composition dissolved within a carrier medium, said carrier medium being selected from the group consisting of a supercritical fluid and a liquified gas, with said textile treatment composition being selected from the group consisting of a sizing agent and a textile dye, said mixture being introduced into said passageway at an acute angle relative to said longitudinal axis of said passageway so that any individual yarn fibers attached to and extending outwardly from said strand will wrap around said strand during introduction of said mixture into said passageway, said carrier medium rapidly expanding when said mixture is introduced into said constricted region of said passageway so that said textile treatment composition within said mixture is precipitated therefrom and applied onto said yarn strand to produce a treated yarn product;

introducing a carrier gas into said medial portion of said passageway during said introducing of said chemical treatment mixture into said constricted region of said passageway, said carrier gas passing over and around said yarn strand as it passes through said constricted region to further facilitate wrapping of said individual yarn fibers around said yarn strand and to facilitate drying of said treated yarn product;

introducing an additional gas into at least one of said first end portion and said second end portion of said passageway during said introducing of said chemical treatment mixture into said constricted region of said passageway, said additional gas producing back-pressure within said passageway which prevents entry of air into said passageway and prevents leakage of said textile treatment composition and said carrier medium outwardly from said passageway; and passing said treated yarn product through said opening in said baffle member within said second end portion of said passageway in order to further facilitate drying of said yarn product.

18. A method for applying a textile treatment composition to textile materials comprising the steps of:

providing a treatment apparatus comprising a conduit member, said conduit member comprising at least one passageway passing entirely through said conduit member, said passageway being surrounded by a side wall and comprising a first end portion, a second end portion, and a medial portion between said first end portion and said second end portion, said medial portion comprising at least one section thereof in which said side wall extends inwardly to form a constricted region within said passageway, said treatment apparatus further comprising a chamber connected to and in fluid communication with said passageway of said conduit member, said chamber comprising a chemical treatment mixture therein, said mixture comprising a textile treatment composition dissolved within a carrier medium, said carrier medium being comprised of a chemical composition which is pressurized in order to generate a product selected from the group consisting of a supercritical fluid and a liquified gas;

passing a yarn strand through said passageway so that said strand moves continuously therethrough;

delivering said chemical treatment mixture from said chamber into said constricted region of said passageway during movement of said yarn strand through said passageway, said carrier medium rapidly expanding when said mixture is introduced into said constricted region of said passageway so that said textile treatment composition within said mixture is precipitated therefrom and applied onto said yarn strand to produce a treated yarn product, said chemical composition used to generate said carrier medium remaining within said passageway; and transferring said chemical composition from said passageway back into said chamber for reuse in treating additional quantities of yarn which enter said treatment apparatus.

* * * * *